United States Patent [19]

Craft

[11] Patent Number: 5,008,990

[45] Date of Patent: Apr. 23, 1991

[54] HARDWARE FOR MOUNTING A CASKET HANDLE BAR

[75] Inventor: William K. Craft, North Bend, Ohio

[73] Assignee: Batesville Casket Company, Inc., Batesville, Ind.

[21] Appl. No.: 501,015

[22] Filed: Mar. 29, 1990

[51] Int. Cl.[5] ..... A61G 17/00

[52] U.S. Cl. ..... 27/2; 16/112

[58] Field of Search ..... 27/2, 35, 20, 6; 16/112

[56] References Cited

U.S. PATENT DOCUMENTS 385,707 7/1888 Gould et al. ..... 27/10

4,237,590 12/1980 Work ..... 27/2 X

*Primary Examiner*—Richard E. Chilcot, Jr.

*Attorney, Agent, or Firm*—Wood, Herron & Evans

[57] ABSTRACT

A casket has a metal shell. A plurality of blocks project from the surface of the shell and are integral with the shell. Mounts are secured over the blocks and have laterally-projecting trunnions. Arms are mounted on the trunnions at one end and receive a handle bar at the other, thereby providing a pivotable handle bar mount.

8 Claims, 2 Drawing Sheets

HARDWARE FOR MOUNTING A CASKET HANDLE BAR

BACKGROUND OF THE INVENTION

This invention relates to a casket, and more particularly, to the mounting of hardware for the handle bar on the casket.

In the manufacture of metal caskets, it is conventional to form a shell. A hole is drilled where the hardware that mounts the handle bar is to be mounted. The bar mount has a bolt projecting from it. The bolt is passed through the hole formed in the casket shell and is secured to the casket shell with a nut and washer system that secures the hardware to the shell and seals the hole against leakage.

Bolt holes have been a problem. The casket manufacturer desires to warrant that the casket will be watertight and airtight for a specified number of years. The Federal Trade Commission is watchful to be sure that the caskets manufactured under such warranty will in fact perform in accordance with the warranty. Thus, the formation of the seal at the bolt holes becomes critically important.

Further, the inwardly-projecting bolts and nuts present protuberances that add to the difficulty of cleaning the caskets. It is therefore desirable to have a completely smooth interior so that the casket can be more easily cleaned.

SUMMARY OF THE INVENTION

It has been an objective of the present invention to mount the handle bar of a casket and its associated hardware without requiring the formation of holes in the casket walls and, of course, eliminating bolts projecting through the holes into the interior of the casket.

The foregoing objective of the present invention has been attained by providing a block that projects from the exterior surface of the casket at each position where the bar mounting hardware is mounted. The block may have a rough finish. A bar mount is secured by screws to the block. The bar mount has a finished exterior surface, and when it is secured to the block, the block is totally concealed. The bar mount has laterally-projecting trunnions. Arms having holes at one end are adapted to receive the trunnions. The arms also have holes at the opposite end to receive the handle bar. Initially, the arms are slidable on the bar so as to enable the arms to be placed on the bar and then slid snugly against the bar mount with the trunnions received in the respective arm holes. Set screws fix the arms against the bar mount. Since the arms have a finish identical to that of the bar mount, a very attractive set of hardware is presented by the bar and hardware.

Summarizing, when the hardware is assembled, the bar is securely pivotably mounted on the shell, the hardware is attractively finished, and there are no holes through the shell.

As an additional feature of the invention, it is contemplated that the tips or ends of the bar will be received in arms normally mounted at the corners of the casket. Each arm has a recess to receive the bar end. The face of the bar opposite the recess is closed and finished, thereby eliminating the conventional exposed projecting bar tip. To the extent that these arms that receive the tips are mounted at the corners of the casket, the trunnions on the bar mount will project at 45° to the orientation of the trunnions on the sides of the shell.

Thus, at the corner, the bar mount will mount on one side an arm that receives the tip of the longitudinal bar at the side of the shell. On the opposite side of the bar mount, the arm will receive the tip of a bar mounted across the end of the shell.

BRIEF DESCRIPTION OF THE DRAWINGS

The several objectives and features of the present invention will become more readily apparent from the following detailed description taken in conjunction with the accompanying drawings in which.

DETAILED DESCRIPTION OF THE INVENTION

Figure 1:
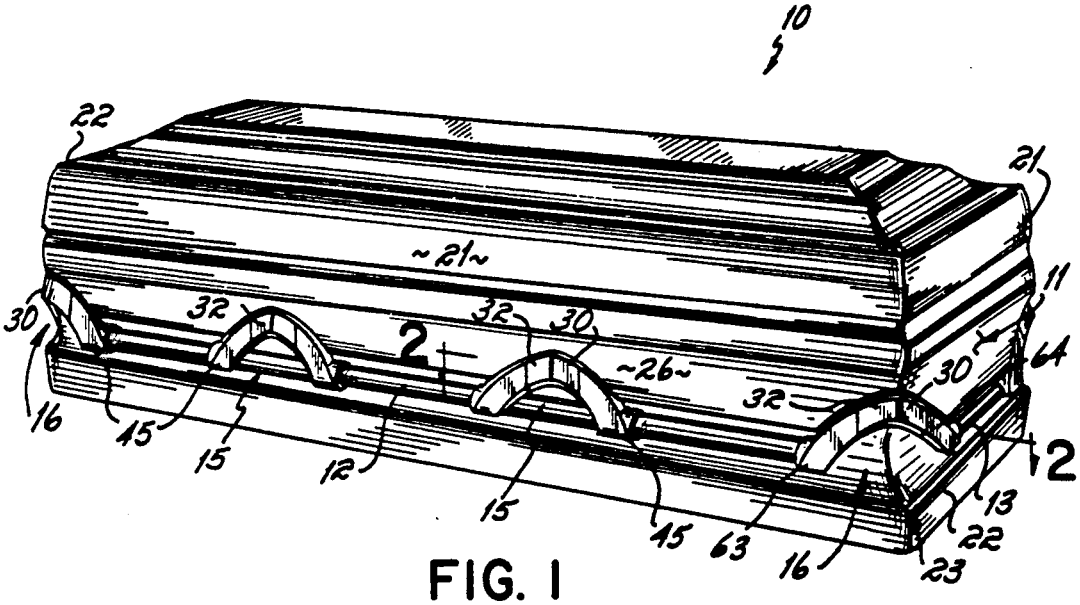
FIG. 1 is a perspective view of a casket employing the invention.

Referring to FIG. 1, a casket 10 has a shell 11. Longitudinal handle bars 12 are mounted on each side and transverse handle bars 13 are mounted on each end. The handle bars 12 and 13 are mounted by sets of side wall hardware 15 and by sets of corner hardware 16, the corner hardware differing from the side wall hardware in certain minor respects, as will appear below.

Figure 2:
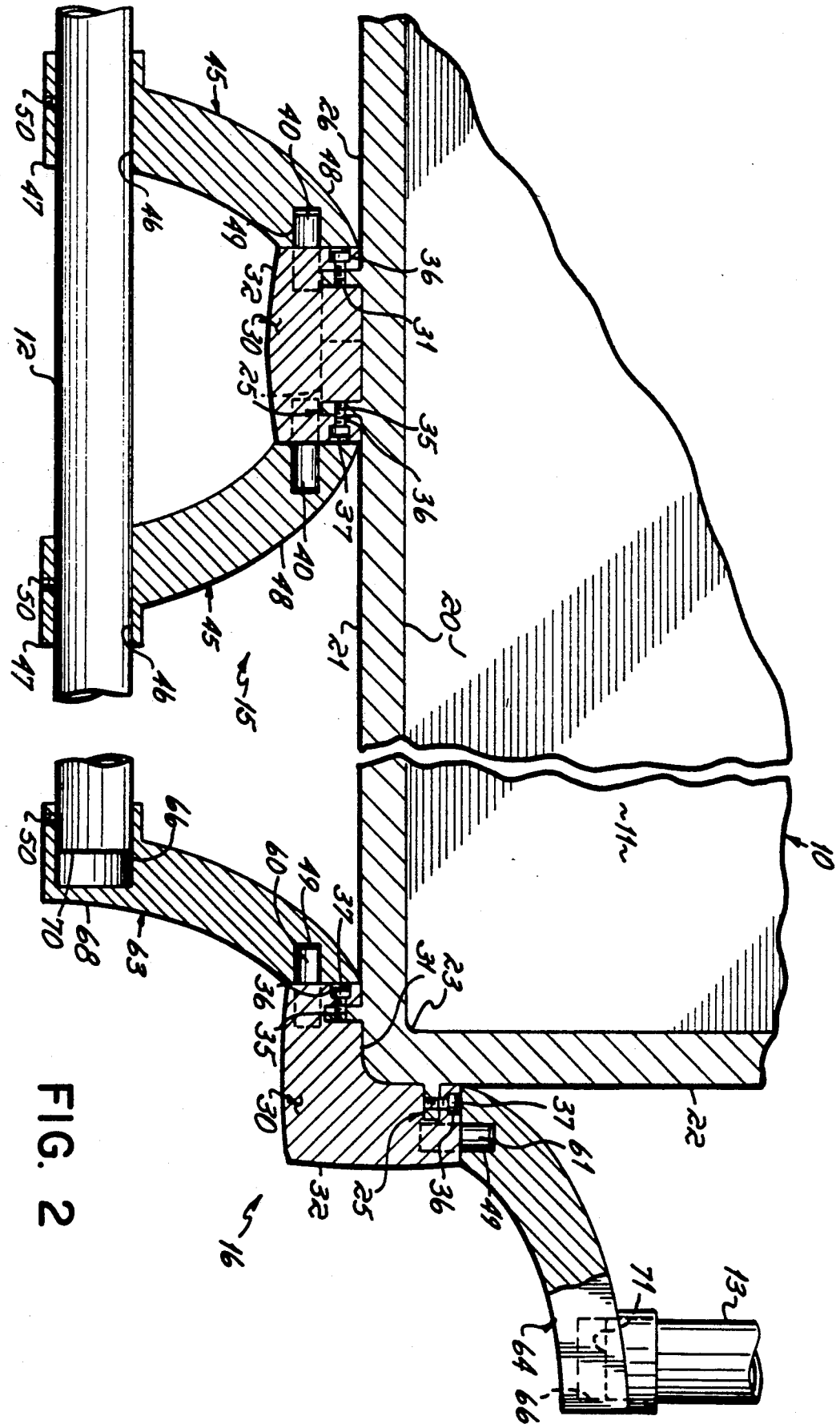
FIG. 2 is a cross-sectional view taken along lines 2—2 of FIG. 1 of a quadrant of the casket.

Referring to FIG. 2, the casket shell 11 has a relatively smooth interior 20 at the locations where the hardware 15 and 16 is mounted. The casket may be cast, stamped or otherwise fabricated from metal. The casket has side walls 21, end walls 22 and corners 23 joining the side walls and end walls. Each side wall has two blocks 25 projecting from the finished exterior surface 26. In the illustrated embodiment, each block 25 is formed in the shape of a W, but it will be understood that the invention admits of considerable variation of that configuration. The block 25 may be cast integrally with a cast shell. It may be stamped integrally with a stamped shell, or it may be secured as by welding to the exterior of the shell. The finish of the block can be rough, for it does not form any part of the casket that can be viewed when the casket is completed.

Figure 3:
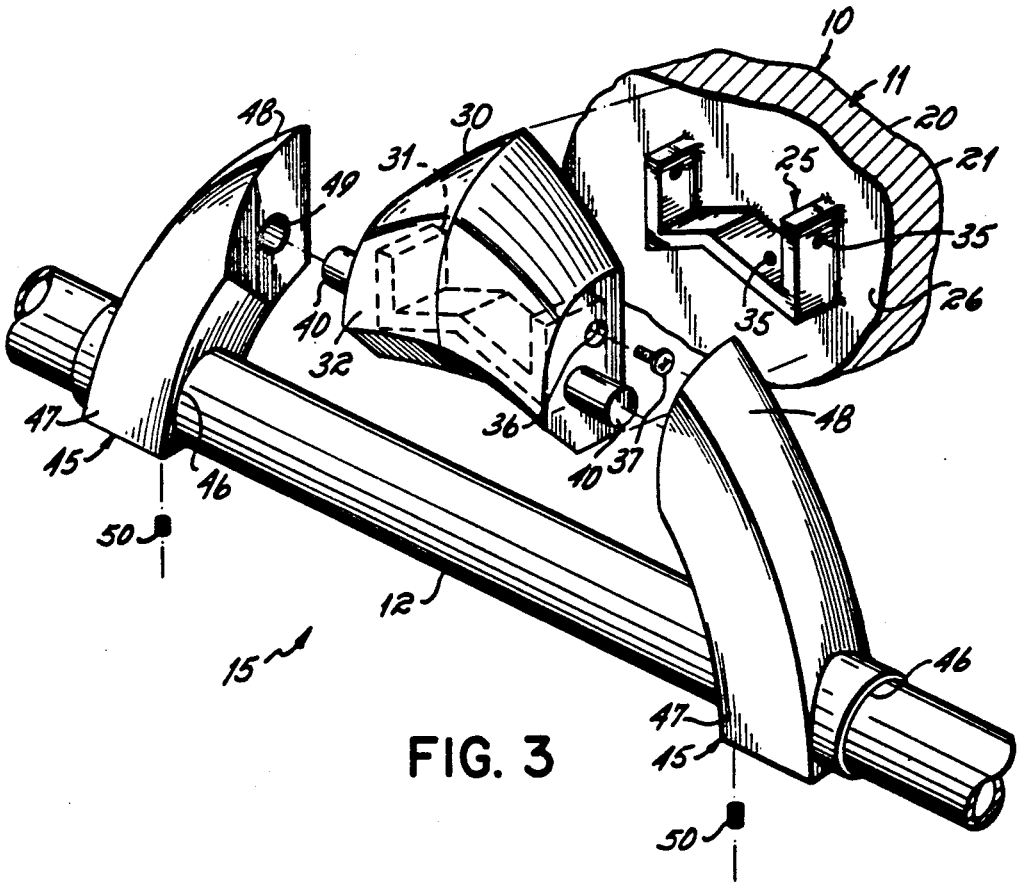
FIG. 3 is a disassembled perspective view of the hardware of the present invention.

A bar mount 30 has an unfinished interior 31 that is cup-shaped or recessed to receive, snugly, the block 25 as shown in FIGS. 2 and 3. When mounted over the block 25, the bar mount totally conceals the block. Its exterior wall 32 is finished to give it a decorative appearance. The block 25 has threaded holes 35 and the bar mount 30 has holes 36 aligned with the threaded holes 35 when the bar mount 30 is in place over the block 25. Screws 37 passing through the holes 36 and the threaded holes 35 secure the bar mount 30 in place on the block 25. A portion of the lifting force to carry the casket will be applied to each bar mount. That force will only be minimally applied to the screws 37. The matching configuration 33 of the interior of the bar mount 30 and the exterior of the block 25, coupled with their snug fitting relationship, causes the force on the bar mount to be applied directly to the block.

Each bar mount 30 has a pair of laterally-projecting trunnions 40. When mounted on the side wall 21 of the casket, the two side wall bar mounts will have their trunnions 40 axially aligned.

The handle bar 12 at each side of the shell has two pairs of arms 45 slidably mounted on it. The arms have longitudinal holes 46 passing through one end 47 to receive the bar 12. Each arm 45 has at the other end 48 a recess 49 that receives a trunnion 40.

To mount the bar 12 on the casket 10, the arms 45 are initially in a slidable relation to the bar 12. The bar is held in position while the arms are slid toward each other to cause the trunnions 40 to be received in the bores 49. When in place, a set screw 50 threaded into each arm 45 secures the arm in proper position on the bar 12.

The arms have a fine finish on their exterior surface matching that of the bar mount 30. When each hardware assembly is in position on the block 25, the bar 12 is reliably secured to the shell and is pivotable with respec to the shell, the bar being pivotal about the axis of the trunnions 40. No holes or bolt holes are required to pass through the shell.

Optionally, the shell can be provided with corner hardware 16 as shown in FIG. 2. The corner hardware 16 is very similar to that of the side hardware 15 but differs only in respect to the need to provide different angles in order for the hardware 16 to be mounted on the corner with trunnion axes at right angles to each other.

More specifically, the hardware 16 has a W-shaped block 25 covered by a cup-shaped bar mount 30. The bar mount 30 has a longitudinal trunnion 60 and a transverse trunnion 61 whose axes are at right angles to one another. A side arm 63 and an end arm 64 are mounted on the respective trunnions 60 and 61. The arms 63 and 64 have bar-receiving recesses 66, but the arms have closed faces 68 opposite the recesses. The arm 63 receives a tip 70 at the end of the bar 12 and the arm 64 receives a tip 71 at the end of the transverse bar 13.

From FIGS. 1 and 2, it can be seen that the hardware presents a very attractive appearance of integrated bar and hardware circumscribing the complete casket seal. The integral blocks 25 transmit the lifting force to the shell 11 without the need of bolts or bolt holes. The handles transmit lifting force to the blocks through the arms 45 and bar mounts 30 with the forces being taken up between the bar mount and block principally by virtue of the snug-fitting relati182 block 25.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. In a casket having a metal shell, a hardware assembly comprising:

a block fixed to said shell, a fixed handle bar mount mounted over said block, said bar mount having laterally, horizontally-projecting trunnions, a horizontal bar, a pair of arms slidable on said bar, each said arm having a hole to receive a trunnion, and means to fix each said arm on said bar after it receives said trunnion.

2. A hardware assembly as in claim 1 in which said bar mount is cup-shaped to receive and conceal said block, sair bar mount presenting an exterior finished surface.

3. A hardware assembly as in claim 1 in which said block is cast integrally with said shell.

4. A hardware assembly as in claim 1 in which said block is welded to said shell.

5. A hardware assembly as in claim 1, said block being in the shape of a W, said bar mount having an interior recess in the shape of a W, the bar mount recess snugly mating with said block so that the load on said bar mount is transmitted directly to said block.

6. In a casket having a metal shell, a hardware assembly for the corner of the casket comprising:

a block fixed to the corner of said shell, a fixed handle bar mount mounted over said block, said bar mount having a longitudinal trunnion projecting along the side of the shell and a transverse trunnion projecting across the end of the shell, a longitudinal bar extending along the side of said shell and a transverse bar extending across the end of said shell, said bars having ends terminating adjacent said bar mount, an arm on each side of said bar mount, one end of each said arm having a first recess that receives a trunnion to pivotally mount said arm on said bar mount, the other end of said arm having a second recess to receive the end of a respective bar.

7. A casket comprising:

a generally rectangular metal shell, a longitudinal bar on each side of said shell, a transverse bar on each end of said shell, and plural hardware assemblies as in claim 1 on the sides and corners of said shell to pivotally mount said longitudinal and transverse bars to said shell.

8. In a casket having a metal shell, a hardware assembly comprising:

a block fixed to said shell, a fixed handle bar mount mounted over said block, said bar mount having a laterally-projecting trunnion, a horizontal bar mounted on said shell and having an end disposed adjacent said handle bar mount, an arm having a recess on one side to receive said trunnion and a recess on the other side to receive said bar, the faces of said arm opposite said recesses being closed and finished.

* * * * *

UNITED STATES PATENT AND TRADEMARK OFFICE

CERTIFICATE OF CORRECTION

PATENT NO. : 5,008,990

DATED : April 23, 1991

INVENTOR(S) : William K. Craft

It is certified that error appears in the above-identified patent and that said Letters Patent is hereby corrected as shown below:

Column 3, line 15, "respec" should be -- respect -- .

Column 3, line 46, "relatil82" should be -- relationship -- .

Column 3, line 46, after "relationship" insert

-- between the bar mount 30 and -- .

Column 4, line 10, "sair" should be -- said -- .

Signed and Sealed this

Fifteenth Day of September, 1992

*Attest:*

*Attesting Officer*

DOUGLAS B. COMER

*Acting Commissioner of Patents and Trademarks*